United States Patent [19]

Klar et al.

[11] Patent Number: 4,921,665

[45] Date of Patent: May 1, 1990

[54] PROCESS FOR PREPARING POWDER METAL PARTS WITH DYNAMIC PROPERTIES

[75] Inventors: Erhard Klar, Beachwood; Mark Svilar, Orange Village; David F. Berry, Westlake, all of Ohio

[73] Assignee: SCM Metal Products, Inc., Cleveland, Ohio

[21] Appl. No.: 166,879

[22] Filed: Mar. 11, 1988

[51] Int. Cl.[5] ..... C22F 1/00

[52] U.S. Cl. ..... 419/23; 419/35; 419/36; 419/37; 419/39; 419/58; 419/27; 419/10; 419/11; 419/12; 419/29

[58] Field of Search ..... 419/23, 35, 36, 37, 419/39, 58, 27, 10, 11, 12, 29

[56] References Cited

U.S. PATENT DOCUMENTS

| | | | |
|---|---|---|---|
| 3,425,828 | 2/1969 | Cape | 419/23 |
| 3,720,551 | 3/1973 | Allen | 419/23 |

*Primary Examiner*—Stephen J. Lechert, Jr.

*Attorney, Agent, or Firm*—Lieberman Rudolph & Nowak

[57] ABSTRACT

The present invention relates to porous powder metal (P/M) parts having improved dynamic properties such as impact and fatigue strength. These properties are achieved by the use of finer metal powders.

7 Claims, No Drawings

PROCESS FOR PREPARING POWDER METAL PARTS WITH DYNAMIC PROPERTIES

DESCRIPTION OF PRIOR ART

Powder metallurgy is a metal-forming technique that allows the economic mass production of relatively complex shaped parts from metal powders. The impact and fatigue strength of such parts are quite low because of the presence of pores throughout the part. The low dynamic properties of these porous substances severely restrict the use of such parts. For example, the impact strength of powder metal ("P/M") parts is important for many applications, e.g., gears wherein a critical region is at the root of the gear teeth with weakness at that point leading to gear failure; and in hammers for use in hammer type mills wherein a critical area is the area between the head and the shank. Imperfection in this area can lead to failure.

While it is well known that increasing the density of a part will, generally, significantly improve its dynamic properties, much higher densities usually are at the expense of higher cost. It is, therefore, an object of the instant invention to improve the dynamic properties of a porous part by means other than by raising its density. A further object of the invention is to significantly improve the dynamic properties of a porous P/M part without raising its density and without a significant increase in cost.

SUMMARY OF THE INVENTION

The present invention significantly improves the impact and fatigue strength of porous P/M parts by using a finer powder, for instance −150 or −170 mesh, in comparison to the widely, if not exclusively, used state of the art −80 or −100 mesh powders. The invention results in significantly (20 to 30%) improved impact and fatigue strength at identical values of sintered density. The improvements are effective over a wide range of densities.

DETAILED DESCRIPTION OF THE INVENTION

The porous P/M parts of this invention having improved impact and fatigue strength are produced from a fine powder mixture having a particle size of for example −150 or −170 mesh. The resulting parts are pressed and sintered using procedures typical of industrial practice and, for instance as described in Metals Handbook, Vol. 7, Powder Metallurgy, Published by American Society of Metals, Metals Park, Ohio, p.322 and 360. Dogbone tensile bars (MPIF standard No. 10) as well as Izod impact bars were made and then tested for density, tensile strength, yield strength, elongation, impact strength and fatigue strength. Such testing indicated that the use of a finer powder mesh significantly improved the impact strength, fatigue strength and elongation at about the same density.

The following specific examples are illustrative of the present invention.

EXAMPLE 1

A very widely used commercial iron powder, designated as A1000 (available from Hoeganaes Corp.), was blended with 0.9% graphite (commercially available and widely used in the industry) and with 0.75% Acrawax C (Chemical Abstracts Reg. No. 110-30-5) using typical pressing and sintering procedures. Dogbone tensile bars (MPIF Standard No. 10) as well as Izod impact bars, were made. The compacting pressure was 30 tsi. The sintering conditions were: 30 minutes at 2050 degrees F. in dissociated ammonia. The sintered bars were then tested for density, ultimate tensile strength, yield strength, elongation, impact (unnotched Charpy) strength, and fatigue strength.

EXAMPLE 2

Materials and procedures were identical to Example 1 except that the +150 mesh fraction of the iron powder was removed by screening prior to its use. A comparison of the properties of this example with those of Example 1 indicated that the removal of the +150 mesh fraction significantly improved impact strength, fatigue strength, and elongation at about the same density.

EXAMPLE 3

An iron powder of the designation A1000PF, (available from Hoeganaes Corp.) was blended with 0.5% graphite (Lonza Electrographite), 0.75% Acrawax C, and 0.05% boron (in the form of an alloy powder). The powder blend was pressed into Izod impact bars having a density of about 7.0 g $cm^3$. The bars were sintered in a vacuum furnace at about 2050 degrees F. for about 30 minutes. Thereafter they were copper-infiltrated also in a vacuum furnace at about 2050 degrees F. for about 7 minutes. The bars were then heated to about 1650 degrees F. for about 30 minutes to achieve an austenitic microstructure. After quenching in water, the bars were tempered at about 350 degrees F. for about 60 minutes. Density, impact strength and hardness were then determined using three samples.

| | |
|---|---|
| Density, g/$cm^3$ | 7.8 |
| Impact Strength, Ft. lb | |
| Sample 1 | 69 |
| Sample 2 | 72 |
| Sample 3 | 90 |

EXAMPLE 4

The impact bars of this example were made exactly as in Example 3 with the exception that the coarse +100 and +170 mesh fractions were removed from the iron powder prior to its use. The properties of these bars are shown in the following table:

| | +100 mesh removed | +170 mesh removed |
|---|---|---|
| Density, g/$cm^3$ | 7.8 | 7.8 |
| Impact strength, ft. lb | | |
| Sample 1 | 64 | 112 |
| Sample 2 | 100 | 117 |
| Sample 3 | 105 | 123 |

It is clear from a comparison of Examples 3 and 4 that not only did the impact strength significantly improve (by 52%) by removing the +170 mesh fraction, but also the scatter of the individual data points became much narrower. This feature is very desirable as it allows the design engineer to use this material with superior reliability and at a higher percentage of its average value. Furthermore, these examples also demonstrate that the instant invention can be applied to different P/M compositions as well as to infiltrated materials.

EXAMPLE 5

A recently developed binder-treated powder, consisting of 0.9% graphite, 0.75% Acrawax C, and a balance iron (1000A) designated as "Bondalloy" (available from Hoeganaes Corp.) was processed as the material of Example 1. The properties of the sintered bars were then determined in like manner.

EXAMPLE 6

The sintered bars of this example were made from the same raw materials as in example 5 except that the +170 mesh fraction was removed prior to use. Processing was identical to that in example 5. The same properties were then determined.

A comparison of the results of examples 5 and 6 shows that the instant invention is also effective with this recently developed binder-treated powder.

The present invention is not intended to be limited to the disclosure herein, and changes and modifications may be made by those skilled in the art without departing from the spirit and the scope of the present invention. Such modifications and variations are considered to be within the purview and the scope of the present invention and the appended claims.

We claim:

1. A process of manufacturing powder metal parts by powder metallurgical technique, comprising the use of iron powders having a particle size small enough to pass through a 140 U.S. mesh screen whereby said metal parts have improved impact and fatigue strength.

2. The process of claim 1 wherein the powder metal parts are made from a binder-treated powder.

3. The process of claim 1 wherein the powder metal parts are made from infiltrated steels.

4. The process of claim 1 wherein the powder metal parts are made from low alloy steels.

5. The process of claim 1 wherein the powder metal parts are made from stainless steels.

6. The process of claim 1 wherein the powder metal parts are made from tool steels.

7. The process of claim 1 wherein the powder metal parts are copper-infiltrated.

* * * * *